US007762936B2

(12) United States Patent
Conley et al.

(10) Patent No.: US 7,762,936 B2
(45) Date of Patent: Jul. 27, 2010

(54) STRETCHING AND CONDITIONING APPARATUS

(75) Inventors: James Conley, Fort Worth, TX (US); Garland McKelvain, Burleson, TX (US); Ronald Ziotkowski, Burleson, TX (US)

(73) Assignee: Stealth Fitness, LLC, Burleson, TX (US)

( * ) Notice: Subject to any disclaimer, the term of this patent is extended or adjusted under 35 U.S.C. 154(b) by 134 days.

(21) Appl. No.: 11/757,503

(22) Filed: Jun. 4, 2007

(65) Prior Publication Data

US 2008/0182730 A1 Jul. 31, 2008

Related U.S. Application Data

(60) Provisional application No. 60/886,858, filed on Jan. 26, 2007.

(51) Int. Cl.
*A63B 21/00* (2006.01)
*A63B 26/00* (2006.01)

(52) U.S. Cl. ..... 482/131; 482/142; 482/907

(58) Field of Classification Search ..... 482/51, 482/55, 56, 79, 80, 91–96, 142, 145, 907, 482/131, 133–137; 601/23, 34, 35, 5; *A63B 21/00, A63B 26/00*

See application file for complete search history.

(56) References Cited

U.S. PATENT DOCUMENTS 3,892,404 A 7/1975 Martucci
3,966,200 A * 6/1976 Kirk ..... 482/23
4,241,915 A 12/1980 Noble et al.
4,247,098 A * 1/1981 Brentham ..... 482/112
4,546,968 A * 10/1985 Silberman ..... 482/97
4,635,934 A * 1/1987 Roethke ..... 482/104
4,784,121 A * 11/1988 Brooks ..... 601/34

(Continued)

FOREIGN PATENT DOCUMENTS

JP 08-126718 A 5/1996

(Continued)

OTHER PUBLICATIONS

Stealth Fitness LLC; Still photographs representing video shown to Examiner; Oct. 7, 2009.

(Continued)

*Primary Examiner*—Loan Thanh
*Assistant Examiner*—Oren Ginsberg
(74) *Attorney, Agent, or Firm*—Carr LLP

(57) ABSTRACT

An apparatus for stretching at least the hamstring muscle of a user's leg is provided having a first support member for supporting the back of the leg of the user at or near the knee at least at the commencement of stretching and a second support member for engaging the back of the lower leg portion of the user during stretching. This first support member is disposed in front of the user during stretching of the hamstring muscle of the user's leg and the second support member is displaceable generally in a direction to stretch the hamstring muscle of the user's leg. An actuator operable by the user during use of the apparatus can be used for displacing at least the second support member generally in a direction to cause stretching of at least the hamstring muscle of the user's leg.

47 Claims, 5 Drawing Sheets

U.S. PATENT DOCUMENTS

| | | | | |
|---|---|---|---|---|
| 4,828,255 | A | 5/1989 | Lahman | |
| 4,844,454 | A * | 7/1989 | Rogers | 482/131 |
| 4,861,025 | A | 8/1989 | Rockwell | |
| 4,877,239 | A | 10/1989 | Dela Rosa | |
| 4,884,802 | A | 12/1989 | Graham | |
| 4,986,261 | A * | 1/1991 | Iams et al. | 601/35 |
| 5,122,106 | A * | 6/1992 | Atwood et al. | 482/131 |
| 5,277,681 | A * | 1/1994 | Holt | 482/112 |
| 5,328,424 | A | 7/1994 | Greco | |
| 5,338,278 | A | 8/1994 | Endelman | |
| 5,405,306 | A | 4/1995 | Goldsmith et al. | |
| 5,421,801 | A | 6/1995 | Davies, III et al. | |
| D362,700 | S | 9/1995 | Breibart et al. | |
| 5,529,560 | A | 6/1996 | Davies, III et al. | |
| 5,607,381 | A | 3/1997 | Endelman | |
| 5,626,547 | A | 5/1997 | Davies, III et al. | |
| 5,681,249 | A | 10/1997 | Endelman | |
| 5,792,033 | A | 8/1998 | Merrithew | |
| 5,885,197 | A | 3/1999 | Barton | |
| 5,938,573 | A | 8/1999 | Davies, III et al. | |
| 6,186,929 | B1 | 2/2001 | Endelman et al. | |
| 6,203,473 | B1 | 3/2001 | Atwood | |
| 6,287,243 | B1 | 9/2001 | Isom et al. | |
| 6,468,192 | B1 | 10/2002 | Doerscheln | |
| 6,565,495 | B2 * | 5/2003 | Slattery | 482/142 |
| 6,764,431 | B2 * | 7/2004 | Yoss | 482/56 |
| 6,767,314 | B2 | 7/2004 | Thompson | |
| 7,004,894 | B1 | 2/2006 | Trotter | |
| 7,104,937 | B2 | 9/2006 | Arbuckle et al. | |
| 7,235,039 | B2 * | 6/2007 | Anders | 482/51 |
| 7,255,665 | B2 * | 8/2007 | Ish, III | 482/102 |
| 7,402,128 | B2 * | 7/2008 | Thonn, Jr. | 482/142 |
| 2004/0092372 | A1 * | 5/2004 | Clark, III | 482/142 |
| 2005/0227837 | A1 * | 10/2005 | Broadbent | 482/148 |
| 2006/0160673 | A1 * | 7/2006 | Tennant et al. | 482/91 |
| 2008/0032877 | A1 * | 2/2008 | Denisco | 482/145 |

FOREIGN PATENT DOCUMENTS

| | | | |
|---|---|---|---|
| KR | 10-0436899 | B1 | 10/2004 |
| WO | WO 94/03141 | A1 | 2/1994 |

OTHER PUBLICATIONS

PCT/US08/52219—International Search Report, ISA/KR, Jun. 12, 2008.

* cited by examiner

*FIG. 2A*
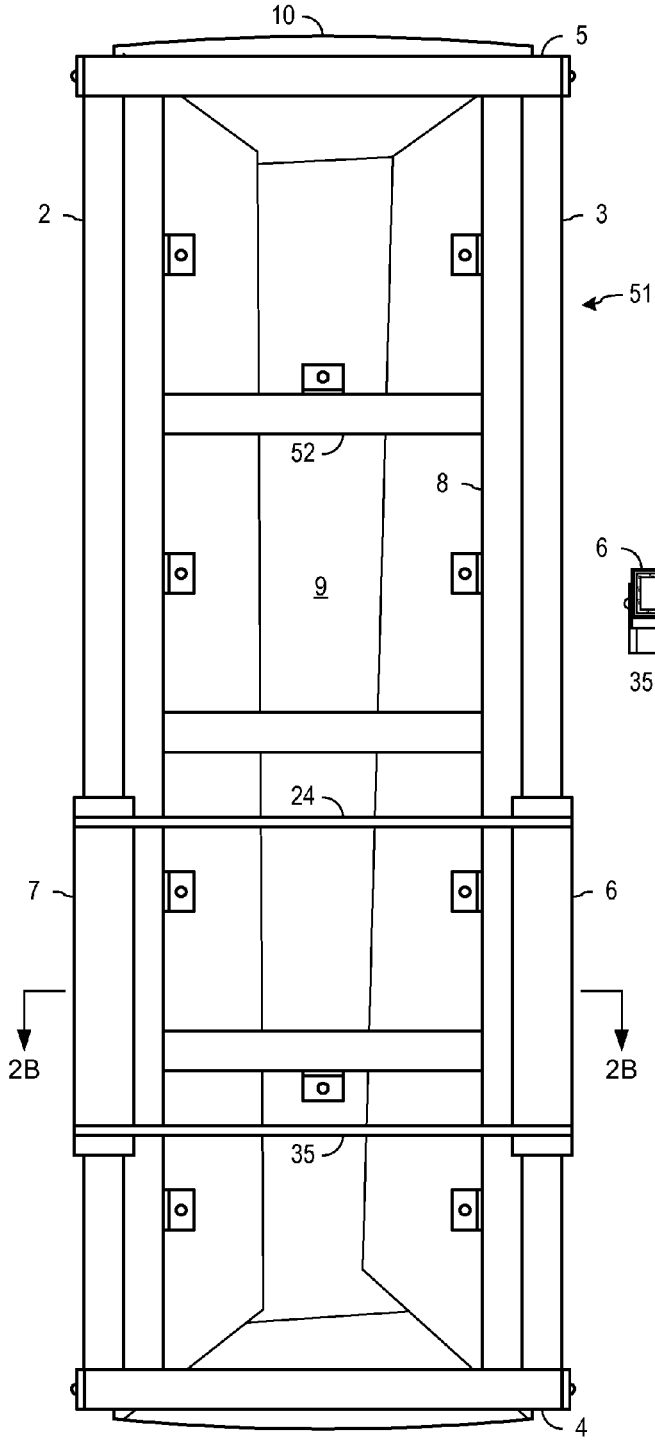
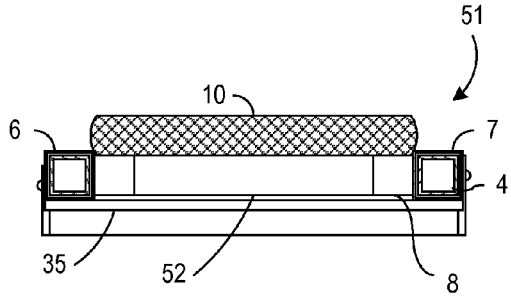
*FIG. 2B*

STRETCHING AND CONDITIONING APPARATUS

CROSS-REFERENCED APPLICATIONS

This application claims priority of co-pending U.S. provisional patent application Ser. No. 60/886,858, entitled "Stretching and Conditioning Apparatus," filed Jan. 26, 2007.

BACKGROUND OF THE INVENTION

1. Field of the Invention

The present invention relates to exercise equipment and, more particularly, to a stretching and conditioning apparatus for stretching a user's hamstring muscles.

2. Description of the Related Art

Stretching of muscles, ligaments and tendons prior to, after and during the course of exercising is important for flexibility and to prevent injury. Currently, the best way for a person to get an effective stretch of the hamstring muscles of their legs is to do stretching with the assistance of a trainer. This requires that the trainer actually apply force to the person's leg to perform the stretching. To do so, the trainer will stabilize the person's leg by hand to prevent it from moving laterally while flexing the leg. Furthermore, the trainer will position the leg being stretched so that it is not in a fully straight position, to prevent too much pressure from being applied to the knee area during the stretching. Having the trainer apply the stretching force also keeps the hamstring relaxed during the stretching.

There are also disadvantages to using a trainer. Many persons who desire to exercise and be limber are not able to use a trainer, for reasons of cost or otherwise. In addition, because the trainer applies the stretching force but cannot feel the stretching sensation, the success of the stretching is greatly dependent upon the accuracy of communication between the person being stretched and the trainer. Since the trainer does not want to unintentionally cause injury to the person being stretched by applying too much force, it is common for the trainer to apply less than optimum force. This results in less stretching than the maximum amount that would be safe and effective.

Some efforts have been made in the past to develop exercise devices that would allow the person to be able to apply their own stretching force, without the need for a trainer. For example, a hamstring stretching machine has been proposed that has a cable and pulley system. The end of the cable is attached to the leg to be stretched and the user pulls on a handle at the other end of the cable to stretch the leg. Such prior machines have disadvantages. They stretch the leg with the leg in a straight position. This actually puts too much pressure on the ligaments and tendons associated with the knee. Pulley systems also afford no lateral stability, allowing the lower leg to potentially turn or move side to side, which can cause problems for the medial and lateral ligaments and can also potentially damage the meniscus.

SUMMARY OF THE INVENTION

The present invention allows a user to apply stretching force to their own hamstring muscles to the degree desired, eliminating the need for a separate trainer, while maintaining horizontal and vertical stability during stretching.

In accordance with an embodiment of the invention, an apparatus for stretching at least the hamstring muscle of a user's leg is provided comprising a first support member for supporting the back of the leg of the user at or near the knee at least at the commencement of stretching, said first support member being disposed in front of the user during stretching of the hamstring muscle of the user's leg; a second support member for engaging the back of the lower leg of the user during stretching, said second support member being displaceable generally in a direction to stretch the hamstring muscle of the user's leg; and an actuator operable by the user during use of the apparatus for displacing at least the second support member generally in a direction to cause stretching of at least the hamstring muscle of the user's leg.

In accordance with another embodiment of the invention, a method for stretching at least the hamstring muscle of a user's leg is provided comprising the steps of: supporting the back of the leg of the user at or near the knee at least at the commencement of stretching by means of a first support member disposed in front of the user during stretching of the hamstring muscle of the user's leg; engaging the back of the lower leg of the user during stretching by means of a second support member displaceable generally in a direction to stretch the hamstring muscle of the user's leg; and displacing at least the second support member generally in a direction to cause stretching of at least the hamstring muscle of the user's leg by means of an actuator operated by the user.

BRIEF DESCRIPTION OF THE DRAWINGS

For a more complete understanding of the present invention and the advantages thereof, reference is now made to the following Detailed Description taken in conjunction with the accompanying drawings, in which:

FIG. 2A depicts a bottom plan view of the support surface of the apparatus;

FIG. 2B depicts a section view of the support surface of the apparatus, from the foot end;

DETAILED DESCRIPTION

Figure 1A:
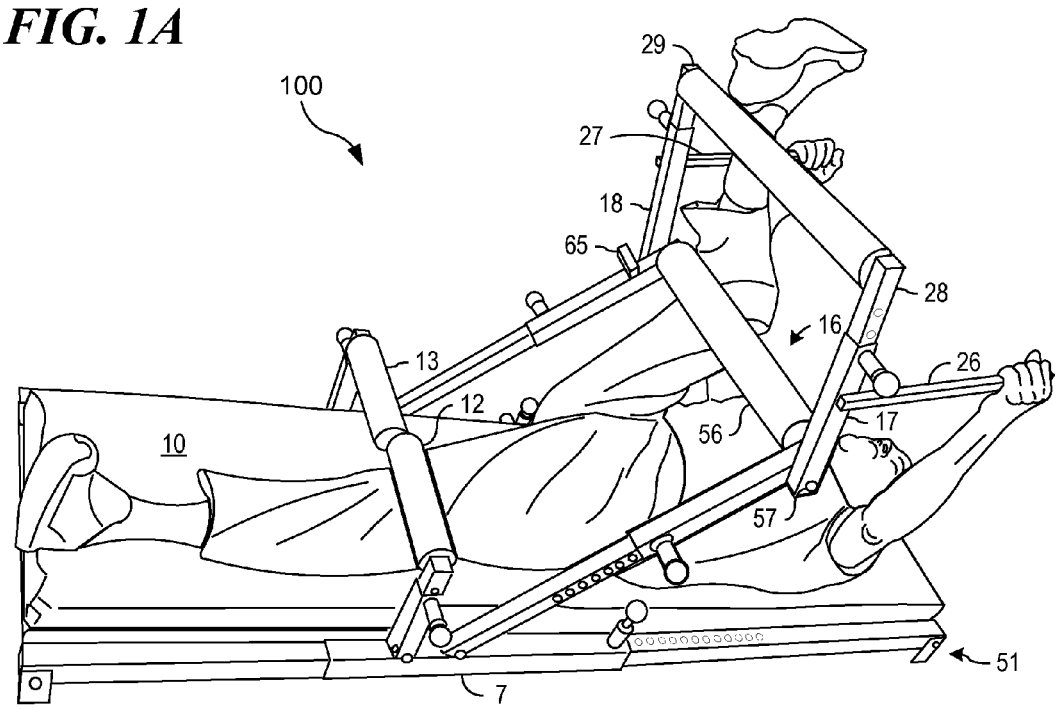
FIG. 1A depicts a perspective view of a stretching and conditioning apparatus in accordance with an embodiment of the present invention; in use by a user.

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. In addition, for the most part, details concerning material thickness, fabrication, welds, bolts, and the like, have been omitted inasmuch as such details are not considered necessary to obtain a complete understanding of the present invention, and are considered to be within the understanding of persons of ordinary skill in the relevant art.

Turning now to the drawings in detail, and initially to FIGS. 1A, 2A, 2B and 3 thereof, the reference numeral 100 generally indicates one exemplary embodiment of a stretching and conditioning apparatus in accordance with the invention. The stretching and conditioning apparatus can include a support surface 10. Support surface 10 can include a body support backing 9, as depicted in FIGS. 2A and 2B, which can be made from a plywood sheet or any other suitably strong material. Foam material (not shown) covered by a plastic sheet 11, which can conveniently be made from vinyl, can be disposed over support backing 9 for comfort.

In use, support surface 10 can be maintained in a horizontal orientation, with the user lying on it, as depicted in FIG. 1A. In other embodiments, the support surface 10 can be maintained at other than a horizontal orientation, at any angle, including vertical. Although the support surface 10 is depicted as having a length approximating the height of the user, the support surface can also be shorter, including having a length approximating the torso of the user. Also, the support surface 10 need not be a separate member, since the floor itself, a seat or a wall can serve as the support surface.

Body support surface 10 can also be hinged approximately in the middle to raise the user's upper torso up, to create an angle as great as 90 degrees while allowing the user to keep his or her non-stretching leg generally horizontal. It is believed that this configuration will make user of the apparatus more comfortable for at least some users.

To provide additional rigidity, body support surface 10 can rest upon a body support frame assembly 8. This body support frame/assembly 8 could rest upon a main frame assembly 51 including a first pair of parallel tubes 2 and 3 (also called the left and right main rails respectively) on the left and right of the body support surface 10, left and right being as referenced by the individual user utilizing the apparatus with his or her back against the body support surface 10. The ends of the left and right main rails 2 and 3 can be connected to a second set of parallel tubes 4 and 5 which are perpendicular to the main rails (also called the main foot rail and main head rail respectively), thereby forming a rectangular main frame assembly 51. Within this main frame assembly 51, a second inner frame assembly 52 made up of body support surface 10 and body support frame assembly 8, can be attached to the main frame assembly 51 with brackets, nuts, bolts, and washers, rivets, clamps, welding or by other convenient means to the main foot rail 4 and the main head rail 5.

Figure 1B:
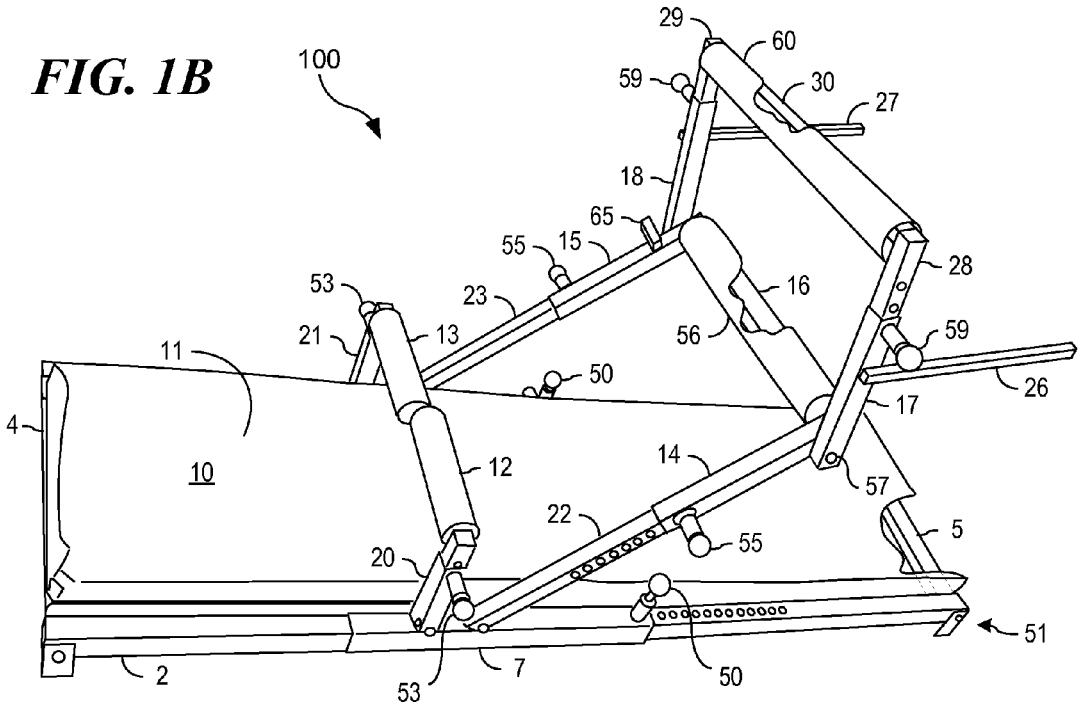
FIG. 1B, depicts a perspective view of a stretching and conditioning apparatus of FIG. 1A, without a user.

Referring to FIGS. 1A and 1B, at least one leg immobilizer can be provided for at least one leg, the hamstring of which is not currently being stretched. In one embodiment, a left leg immobilizer 12 and/or a right leg immobilizer 13 can be provided. The leg immobilizers 12 and 13 can be mounted respectively to a left main slider 7 and a right main slider 6 which can be mounted to and slideably displaceable along the surrounding left and right main rails 2 and 3. Prior to use of the apparatus to stretch the muscles of the user's leg, the left slider 7 and right slider 6 can be fixed in place where desired by pop pins 50 placed into corresponding holes in the left and right main rails 2 and 3 (either by manual pressure, gravity or a spring), thereby holding the slider in a relatively fixed position when stretching is performed.

Generally horizontal leg immobilizers 12 and 13, which can be formed from tubing, can be disposed in front of the user's non-stretching leg to help maintain it in an extended condition while the apparatus is being used to stretch at least the hamstring muscles of the user's leg being stretched. Each of the leg immobilizers 12 and 13 can be covered with foam for comfort and supported by respective upstanding perpendicular tube 20 and 21, welded or otherwise attached (permanently or detachably) to the left and right main sliders 7 and 6. Immobilizers 12 and 13 can extend over the support surface 10 and can be spaced a sufficient clearance therefrom so that a user can fit an extended leg underneath it. Each of the left and right leg immobilizer 12 and 13 transverse bars can be covered with a foam roller.

Each of the upstanding perpendicular tubes 20 and 21 can have an adjustable length, by means of the tubes 20 and 21 slideably fitting into a correspondingly shaped tube attached to sliders 6 and 7 and fixed in place by pop pins 53. This allows the clearance of the leg immobilizers 12 and 13 with respect to the support surface to be adjusted to accommodate different sized users, prior to use of the apparatus to stretch the muscles of the user's leg. However, the leg immobilizers 12 and 13 can be maintained in a fixed position during actual stretching.

The two sliders can be connected on the underneath side of the body support frame 8 by two braces 24 and 35 so that the right and left main sliders 6 and 7 will move as a unit. Alternatively, the sliders 6 and 7 can be allowed to move independently, in which case braces 24 and 35 would not be used.

Each of the sliders 6 and 7 can have left and right side extender stands 17 and 18 attached thereto, which can include lower pivot support members 22 and 23 welded or otherwise securely attached to a respective one of the sliders 7 and 6 and respective upper pivot support members 14 and 15.

Each of the lower pivot support members 22 and 23 can be configured as an angled bar or tube attached to the left and right slider 7 and 6, respectively. Each of the upper pivot support members 14 and 15 can also have a pop pin 55 which can be selectively inserted into corresponding holes in the lower pivot support portion 22 and 23 or vise versa. Prior to use of the apparatus to stretch the muscles of the user's leg, the upper pivot support members 14 and 15 can then be slid up and down the lower pivot support portions 22 and 23, with the pop pins 55 up. When the desired position is reached, the pop pins 55 can be stuck into the holes (either by manual pressure, gravity, friction or a spring), thereby holding the upper pivot support member in a relatively fixed position.

A transverse first leg support member 16 can be attached near the upper end of the pivot support members 14 and 15. The first leg support member 16 can be covered with a cushion 56, if desired, for comfort. In FIG. 1B, a portion of foam pad 56 is shown partially cut away, to show leg support member 16 underneath. Each of the pivot support members 14 and 15 can have pivots 57 near the upper end thereof and extending transversely to the width of the support surface 10. Pivots 57 can be made from a bolt, nut, and washer, pin retained by a cotter pin or the like, or by other convenient means. Because of the angle to the extender stands 17 and 18 with respect to the support surface 10, adjustment of the upper pivot support members 14 and 15 on the lower support members 22 and 23 toward the main head rail will simultaneously raise the extender stands 17 and 18 away from the support surface 10 and move them toward the main head rail end of the support surface 10 to permit individual adjustment to suit the needs for the particular user.

The apparatus 100 can also have elongated members 28 and 29 respectively pivoted to the pivots 57 of the left and right extender stands 17 and 18 of the elongated members. Elongated members 28 and 29 can also have an adjustable length, with coaxial inner and outer tubes, with pop pins 59 fitting into corresponding holes in the upper portion of the elongated members. A second leg support member 30 can be attached transversely at or near the ends of elongated members 28 and 29, which second leg support member 30 can also be covered with a foam pad 60, if desired, for comfort. In FIG. 1B, a portion of foam pad 60 is shown partially cut away, to show leg support member 30 underneath.

One or both of the left and right extender stands 17 and 18 can have actuator levers 26, 27, which levers extend generally toward the user's head and can have grippable portions that can be reached by the user when in normal position with his or her back against the support surface 10, prior to and during normal use of the apparatus for stretching the user's hamstring muscles.

Figure 4:
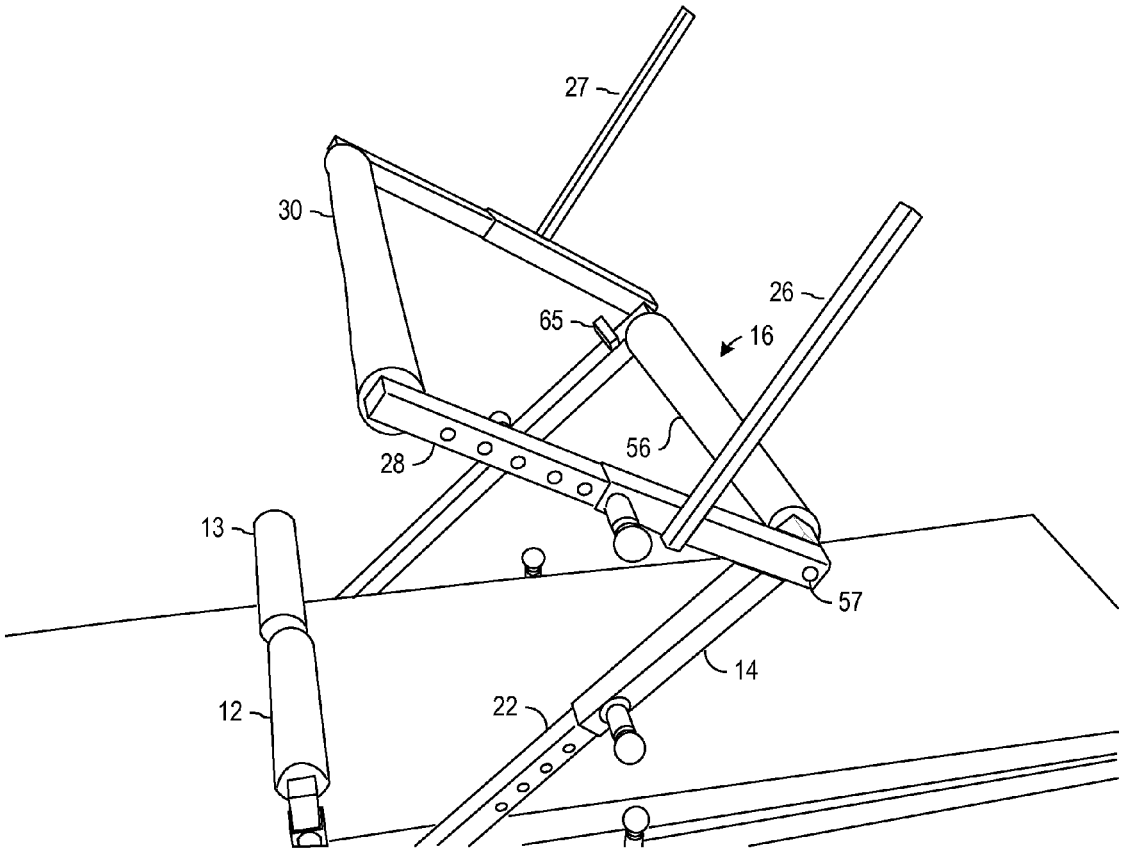
FIG. 4, depicts an enlarged perspective view of another embodiment of the portion of the apparatus including the first and second leg support members and pivots, with the pivots co-axial to the first leg support.

FIG. 4 shows a possible variation of the portion of the apparatus including the first and second leg support members 16 and 30 and pivots 57, where the pivots 57 are co-axial with the first leg support member 16. With this configuration, the first leg support member 16 will stay stationary while the user stretches the hamstring muscle.

Figure 5:
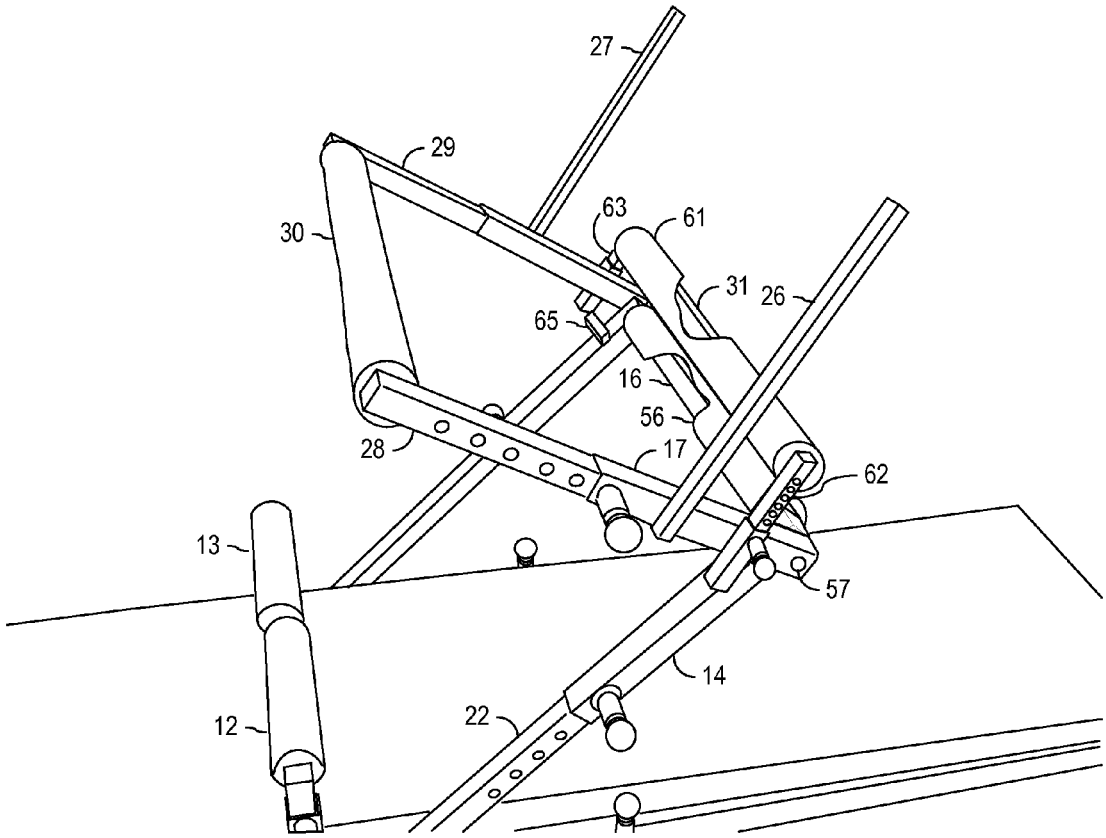
FIG. 5, depicts an enlarged perspective view of another embodiment of the portion of the apparatus including the first and second leg support members and pivots, with an additional third support mounted on stubs.

FIG. 5 shows a possible variation of the portion of the apparatus including the first and second leg support, but in this preferred embodiment there is an additional point of contact against the user's thigh. In this preferred embodiment there can be as many as three points of contact between the invention and the user's leg. This is accomplished by means of the addition of an offset thigh support 31, covered by a foam cover 61. In this variation the first and second support members remain as in the other preferred embodiments. However by means of two stubs 62 and 63 an additional adjustable support is added to elongated members 17 and 18 of the elongated members 28 and 29, above pivot 57.

With this configuration, the first support member 16 still makes initial contact and supports the user's thigh. Once the stretch has begun, however, the offset thigh support member 31, if it hasn't already made contact (which depends on the user's limberness and the various machine adjustments) quickly makes contact with the back of the user's thigh, and can maintain that contact for a greater portion of the stretch thereby assisting in maintaining the muscles in a relaxed state and providing horizontal and vertical stability to the leg being stretched. With this configuration the offset thigh support member 31, which is not shown in the other embodiments, provides added support to the back of the thigh and/or leg, depending on the individual. It creates an additional contact point which assists in the stretch.

The underside of the right thigh of the user can be placed against the surface of the cushion 56 on the first support member 16, facing the user as the user lies face up on the body support foam 10. Both the right upper leg and hip are flexed in this position. Left and right actuator levers 26 and 27 may be grasped and pulled by the user until the second leg support member 30 makes contact with the lower part of the leg, at or near the right ankle, preferably above/superior to the right heel. In this position the leg being stretched is bent/flexed at the knee isolating the hamstring from other unrelated joints and muscle groups. The length of levers 26 and 27 provides mechanical leverage to the user about the pivot pins 57 that secure the left and right extender stands 17 and 18. These stands house the left and right elongated members 28 and 29 which are connected to the second transverse leg support 30. By pulling on the actuator levers 26 and 27, the user may cause the second leg support member 30 to pivot in a direction to stretch the hamstring muscle of the right leg, which is generally towards the user's head. While the right hamstring is being stretched, the left leg immobilizer bar 12 prevents the left leg from lifting, thus assisting in limiting bending of the lower back of the user and enhancing the degree of hamstring stretching. The mechanical advantages provided by the actuator levers 26 and 27 allow the user to remain relatively relaxed thus reducing flexure of the hamstring and further enhancing the effectiveness of the stretching exercise. Because the upper leg being stretched is bent/flexed during the stretching, it eliminates the pressure to unrelated joints, tendons and ligaments such as of the calf or behind the knee, thus eliminating any unnecessary discomfort.

Use of the Stretching and Conditioning Apparatus

In operation, a user selects whether the right leg, left leg hamstring, or both legs simultaneously are to be stretched. In the event the right leg is selected for stretching, the user may be positioned on the body support foam 10 and may slide the left and right main sliders 7 and 6 from a position near the main foot rail 4 to a point between the left knee and left hip of the user, positioning the left leg immobilizer bar 12 at that location, above the left leg. At this location, pop pins 50 may secure the left and right main sliders 7 and 6 from sliding along the left and right main rails 2 and 3 during operation of the device. The vertical height of the left leg immobilizer bar 12 may be adjusted by actuation of pop pins 53 and secured at a comfortable height above or touching the left leg, preferably such that the left knee is not more than slightly bent.

The underside of the right thigh of the user can be placed against the surface of the cushion 56 on the first support member 16, facing the user as the user lies face up on the body support surface 10. As can be seen, the present invention naturally tends to bend the knee prior to the leg/hamstring being stretched.

The invention can stretch the hamstring using a two step process: in the beginning of the stretch, the hip is flexed as the left and right sliders are moved toward the main head rail. It puts the hip (thigh) in an initial flexed position and actually begins the initial part of the stretch. It also bends the knee on almost everyone including the most limber people.

As the second leg support member 30 is moved by the left and right actuator levers 26 and 27 the flex continues and its motion activates the stretch of the hamstring by applying pressure on the lower leg as it pushes it toward the head. The invention can therefore allow the knee to bend, isolating the hamstring and eliminating pain from the ancillary muscles and joints, while at the same time stretching the hip.

This combination of bending/flexing of the knee and then flexing the hip (thigh) is unique and is believed to be one reason why the present invention permits more effective stretching than prior art methods and apparatus.

Left and right actuator levers 26 and 27 may be grasped and pulled by the user to pivot the second leg support member 30 against the lower part of the leg, at or near the right ankle, preferably above/superior to the right heel. The length of levers 26 and 27 provides mechanical leverage to the user about the pivot pins 57 that secure the elongated members 28 and 29 to the lower pivot support members 22 and 23. By pulling on the actuator levers 26 and 27, the user may cause the second leg support member 30 to pivot in a direction to stretch the hamstring muscle of the right leg, which is generally toward the user's head. While the right hamstring is being stretched, the left leg immobilizer 12 prevents the left leg from lifting, thus assisting in limiting bending of the back of the user and enhancing the degree of hamstring stretching. The mechanical advantage provided by the actuator levers 26 and 27 allows the user to remain relatively relaxed, thus reducing flexure of the hamstring and further enhancing the effectiveness of the stretching exercise. Because the upper leg being stretched is flexed at the knee during the stretching, it eliminates the pressure behind the knee, eliminating any discomfort from the knee.

It will be apparent that a substantially mirrored procedure is completed to stretch the left leg of the user.

Figure 3:
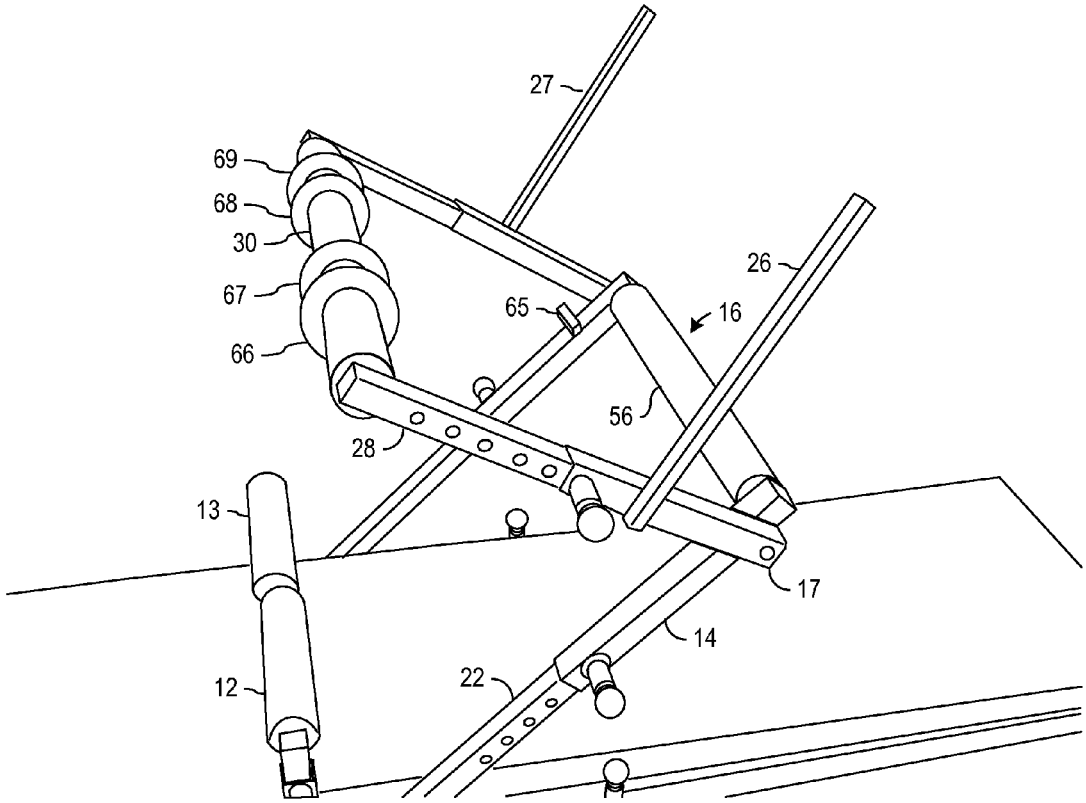
FIG. 3, depicts an enlarged perspective view of the portion of the apparatus depicted in FIG. 1B including lateral leg stabilizers.

Since the second leg support member 30 is relatively rigid and movably supported with pivots so that it does not move freely side to side (unlike a cable), friction between the stretching leg and the leg support as the lower leg presses into the foam 60 will tend to prevent the leg from moving laterally, which facilitates effective stretching. If desired, further lateral support for the lower leg can also be provided. For example, lateral stabilizers 66, 67, 68 and 69 on both sides of the second leg support member 30 that supports the lower leg can be provided to minimize the tendency for the lower leg to twist outward. For example, as depicted in FIG. 3, foam "doughnuts" disposed on the second leg support member 30 on either side of the leg being stretched could be used. Alternately, a deep indentation into the foam 60 could be used, in which case no additional parts would be required. These stabilizers can also be used to provide additional lateral stability for the first support member 16 and the offset thigh support member 31 if desired.

It should be noted that it is possible to use the apparatus and method of the present invention on both legs simultaneously without the use of the immobilizers. Without the use of the immobilizers the result would still be a stretching of the hamstring; however it would be much less effective.

The apparatus of the invention is also very simple to get into and the individual can apply all the pressure he needs himself. To exit the machine, the individual can push the second leg support member 30 back, and allow the right extender stand 18 to rest against stop 65 disposed on upper pivot support member 15. This prevents the second leg support member 30 from dropping onto the user and possibly causing injury. The individual then simply pulls the pop pins 50 and moves the sliders 6 and 7 of the slider assembly forward toward the main foot rail and then slips out.

After the person stretches his or her hamstring for a period of time, the hamstring becomes more flexible. When this occurs, the user is able to change the position of the sliders 6 and 7, as desired, to move the first leg support member 16 farther toward the main head rail 5, allowing the person to easily increase the amount of stretching that can be applied.

As can be seen, in the present invention, the individual controls the complete stretch of his or her own leg. During the stretch the hamstring muscle is completely relaxed as are most of the rest of the muscles in the user's body. The present invention also eliminates jerking motion, twisting and lateral wobbling of the leg during the stretching, as could occur with cables and pulleys, providing the individual user does not incorrectly use the present invention and jerk the actuator levers, etc. The result is a smooth, nearly static stretch, as desired.

Although the present disclosure refers to the hamstring muscle, person skilled in the art will understand that, actually, three muscles form part of what is commonly referred to as the "hamstring." These include the Biceps Femoris, the Semitendinosus and the Semimembranosus.

It should also be noted that other muscles also receive some benefit from stretching performed in accordance with the present invention. These include, for example, the lower back muscles, the erector spinae, which is made up of the iliocostalis and longissimus, and the spinal muscles associated. Groin area muscles also benefit, including the hip flexor (iliopsoas) and groin muscle.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An apparatus for stretching at least a hamstring muscle of a leg of a user of the apparatus, the apparatus comprising:

a first support positioned to engage an upper leg portion above a knee of the user, the upper leg portion extending from a hip of the user to a location in front of and between a lower and an upper torso of the user, such that respective longitudinal axes of both the upper leg portion and the torso form a stretching angle not greater than about ninety degrees;

a second support positioned to engage a lower leg portion below the knee of the user during stretching, wherein the second support moves to extend the lower leg portion relative to the upper leg portion and move the lower leg portion towards the upper torso;

wherein the first support restricts movement of the upper leg portion away from the upper torso beyond the stretching angle;

wherein the first support allows movement of the upper leg portion away from the first support and toward the upper torso as the second support moves to extend the lower leg portion relative to the upper leg portion and generally towards the upper torso; and an actuator coupled to the second support and operable by the user to move at least the second support generally toward the upper torso and to move both the second support and the lower leg portion in at least a portion of an area between the hip and the upper torso of the user such that the second support has an angular displacement toward the upper torso and relative to the hip of the user greater than the concurrent angular displacement, if any, of the first support relative to the hip of the user, to cause stretching of at least the hamstring muscle of the leg of the user by extending the lower leg portion relative to the upper leg portion.

2. The apparatus defined in claim 1, further comprising an elongated member mounted on a pivot, the second support being disposed on the elongated member away from said pivot such that the second support is pivotally moveable generally in a direction to cause stretching of the hamstring muscle of the leg of the user.

3. The apparatus defined in claim 2, wherein the actuator is a manually operable lever attached to the elongated member.

4. The apparatus defined in claim 2, wherein the elongated member has an adjustable length for extending the distance between the second support and the pivot.

5. The apparatus defined in claim 2, further comprising a third support disposed on the elongated member closer to the pivot than said second support, said third support mounted to pivot with the elongated member to engage a back portion of the upper leg portion of the user to urge the upper leg portion away from the first support and toward the upper torso of the user.

6. The apparatus defined in claim 1, wherein the first support is configured to be fixedly disposed in a region generally in front of the user and generally between the top of the head and the crotch of the user during stretching of the hamstring muscle of the leg of the user.

7. The apparatus defined in claim 1, wherein the first support is attached to a base member generally fixed in position with respect to the torso of the user during stretching of the hamstring muscle of the leg of the user.

8. The apparatus defined in claim 7, wherein the first support is positionally adjustable generally along the longitudinal axis of the upper leg portion toward and away from the torso and the hip of the user to adjust a distance between the first support and the upper torso and the hip of the user and generally fixable in position prior to stretching of the hamstring muscle of the leg of the user.

9. The apparatus defined in claim 7, wherein the first support is positionally adjustable generally along the longitudinal axis of the upper leg portion toward and away from the head of the user to adjust a distance between the first support and the upper torso of the user and generally fixable in position prior to stretching of the hamstring muscle of the leg of the user.

10. The apparatus defined in claim 7, wherein the first support is generally aligned with an axis of a pivot.

11. The apparatus defined in claim 7, wherein the first support is positionally adjustable generally toward and away from head of the user for repositioning the first support to decrease the stretching angle during stretching between a first stretch position that defines a first stretch angle and a second stretch position that defines a second stretch angle, wherein the second stretch angle comprises a smaller angle between the longitudinal axis of the upper leg portion and the longitudinal axis of the torso than the first stretch angle to increase the stretch of the hamstring muscle.

12. The apparatus defined in claim 1, further comprising a third support disposed closer to the first support than said second support, said third support disposed to engage the upper leg portion and to urge the upper leg portion away from the first support and toward the upper torso of the user, the third support coupled to the actuator for movement when the second support is moved.

13. The apparatus defined in claim 1, wherein the actuator is a manually operable lever.

14. The apparatus defined in claim 1, further comprising a generally horizontally disposed platform for supporting the back of the torso of the user during stretching.

15. The apparatus defined in claim 14, wherein said platform extends at least the length of the torso of the user.

16. The apparatus defined in claim 1, further comprising a platform disposed at other than in a horizontal orientation for supporting the back of the torso of the user during stretching.

17. The apparatus defined in claim 16, further comprising a seat.

18. The apparatus defined in claim 16, wherein said platform extends substantially the entire length of the body of the user.

19. The apparatus defined in claim 1, wherein the apparatus is adapted to stretch at least the hamstring muscles of one of the legs of the user while another leg of the user is maintained generally stationary during stretching of the hamstring muscle of the leg of the user being stretched.

20. The apparatus defined in claim 19, further comprising a leg immobilizer having a portion extending over the front of the another leg of the user to facilitate maintaining the another leg of the user generally stationary during stretching of the hamstring muscle of the leg being stretched.

21. The apparatus defined in claim 20, wherein the leg immobilizer is disposed on a positionally adjustable and fixable mount such that the leg immobilizer is moveable generally parallel to the longitudinal axis of the torso toward and away from the head of the user and is fixable in position prior to stretching of the hamstring muscle of the leg of the user.

22. The apparatus defined in claim 21, wherein the positionally adjustable and fixable mount of the leg immobilizer is slideably repositionable.

23. The apparatus defined in claim 20, wherein the leg immobilizer is disposed on a positionally adjustable and fixable mount such that the leg immobilizer is moveable generally toward and away from the front of the other leg of the user and is fixable in position prior to stretching of the hamstring muscle of the leg of the user.

24. The apparatus defined in claim 1, wherein the first support is disposed on a positionally adjustable and fixable mount such that the first support is moveable generally along the longitudinal axis of the torso toward and away from the head of the user and is fixable in position prior to stretching of the hamstring muscle of the leg of the user.

25. The apparatus defined in claim 24, wherein the positionally adjustable and fixable mount of the first support is slideably repositionable.

26. The apparatus defined in claim 1, wherein the first support is disposed on a positionally adjustable and fixable mount such that the first support is moveable generally along the longitudinal axis of the upper leg portion toward and away from the torso of the user and is fixable in position prior to stretching of the hamstring muscle of the leg of the user.

27. The apparatus defined in claim 1, wherein the actuator has a grippable portion positioned so as to be grippable by the user during the stretching of the hamstring muscle of the leg of the user.

28. The apparatus defined in claim 1, wherein said actuator comprises one or more manually operable levers disposed on one or more sides of the user.

29. The apparatus defined in claim 1, wherein the first support and the second support are adapted to support either a right leg or a left leg of the user for stretching at least the hamstring muscle thereof.

30. The apparatus as defined in claim 1, wherein the first support is secured against angular displacement relative to the longitudinal axis of the torso of the user greater than angular displacement of the second support relative to the longitudinal axis of the torso of the user during movement of the second support to extend the lower leg portion towards the upper torso of the user.

31. The apparatus as defined in claim 1, wherein the first support is secured against angular displacement relative to the longitudinal axis of the torso of the user during movement of the second support to extend the lower leg portion towards the upper torso of the user.

32. The apparatus as defined in claim 1, wherein the first support is secured against angular displacement relative to the hip of the user greater than angular displacement of the second support relative to the hip of the user during movement of the second support to extend the lower leg portion towards the upper torso of the user.

33. The apparatus as defined in claim 1, wherein the first support is secured against angular displacement relative to the hip of the user during movement of the second support to extend the lower leg portion towards the upper torso of the user.

34. The apparatus as defined in claim 1, wherein, relative to the hip of the user, the actuator angularly displaces the first support and upper leg portion toward the upper torso of the user and such angular displacement is less than the angular displacement of the second support.

35. A method for stretching at least a hamstring muscle of a first leg of a user by an apparatus, the method comprising:

providing a first support;

providing a second support;

engaging, by the second support, a lower leg portion of the first leg of the user below the knee of the user during stretching;

restricting, by the first support, movement of an upper leg portion of the first leg of the user engaged by the first support away from an upper torso of the user beyond a stretching angle, wherein the stretching angle is formed by a longitudinal axis of the upper leg portion extending from a hip of the user to a location in front of and between a lower torso and the upper torso and a longitudinal axis of the torso, and wherein the stretching angle is not greater than about ninety degrees;

providing an actuator coupled to the second support;

moving, by the actuator, both the second support and the lower leg portion relative to the first support and generally towards the upper torso, wherein the actuator moves the second support in at least a portion of an area between the hip and the upper torso of the user such that the second support has an angular displacement toward the upper torso and relative to the hip of the user greater than concurrent angular displacement, if any, of the first support relative to the hip of the user to extend the lower leg portion relative to the upper leg portion and towards the upper torso to cause stretching of at least the hamstring muscle of the leg of the user; and allowing the upper leg portion of the first leg of the user to pivot at the hip away from the first support and generally towards the upper torso, while moving the second support to extend the lower leg portion relative to the upper leg portion generally towards the upper torso.

36. The method defined in claim 35, wherein at least the lower leg portion of the first leg of the user is supported so as to substantially prevent lateral motion during stretching.

37. The method defined in claim 35, wherein restricting, by the first support, movement of an upper leg portion of the first leg of the user also results in initial flexing of the hip of the user and bending of the knee of the first leg of the user and wherein moving at least the second support activates the stretch of the hamstring by applying pressure on the lower leg portion of the first leg of the user generally toward the upper torso of the user, while the knee of the first leg of the user remains flexed.

38. The method defined in claim 35, wherein restricting, by the first support, movement of an upper leg portion of the first leg of the user comprises initially engaging the back of the leg of the first leg of the user by both the first support disposed in front of the user during stretching of the hamstring muscle of the first leg of the user and by a third support, the first support being generally fixed during stretching and the third support being generally movable in the direction of the stretching.

39. The method defined in claim 35, further comprising:

providing a third support disposed closer to the first support than is the second support and displaceable when the second support is moved;

engaging, by the third support, the back of the first leg of the user;

urging, by the third support, the upper leg portion of the first leg of the user away from the first support and toward the upper torso of the user.

40. The method defined in claim 35, further comprising:

providing a second leg immobilizer, wherein the second leg immobilizer has a portion configured to extend over a front of a second leg of the user; and substantially immobilizing, by the second leg immobilizer, the second leg to maintain a second leg in a stationary condition during stretching of the hamstring muscle of the first leg.

41. The method defined in claim 40, further comprising:

adjusting the second leg immobilizer to move the second leg immobilizer generally toward and away from the front of the second leg of the user to adjust a gripping force applied by the second leg immobilizer to the second leg for securing the second leg of the user during stretching of the hamstring muscle of the first leg.

42. The method defined in claim 35, further comprising:

adjusting the distance between the first support and the hip of the user; and fixing the distance of the first support relative to the hip of the user prior to stretching of the hamstring muscle of the first leg of the user.

43. The method defined in claim 35, further comprising:

adjusting the position of the first support along a path substantially parallel to the longitudinal axis of the torso, at least generally toward and away from the head of the user to adjust the stretching angle; and fixing the position of the first support along a path substantially parallel to the longitudinal axis of the torso to set the stretching angle prior to stretching of the hamstring muscle of the leg of the user.

44. The method defined in claim 35, further comprising repositioning the first support between a first stretch position that defines a first stretch angle and a second stretch position that defines a second stretch angle, wherein the second stretch angle comprises a smaller angle between the longitudinal axis of the upper leg portion of the first leg of the user and the longitudinal axis of the torso than the first stretch angle to increase the stretch of the hamstring muscle.

45. A method for stretching at least a hamstring muscle of a leg of a user by an apparatus, the method comprising:

supporting the back of a user on a support surface;

placing a longitudinal axis of an upper leg portion of the leg of the user, extending from a hip of the user to a location in front of and between the lower torso and an upper torso, at an angle less than about ninety degrees to a longitudinal axis of a torso of the user;

providing an elongated member pivotable about at least one pivot location, the pivot location spaced from and in front of the user near the knee of the leg of the user;

providing a thigh support coupled to the elongated member on a first side of the pivot location and a second support coupled to the elongated member on the first side of the pivot location, wherein the thigh support is positioned closer to the pivot location than is the second support;

engaging, by the thigh support of the apparatus, the upper leg portion of the leg of the user above the knee during stretching;

engaging, by the second support, a lower leg portion of the leg of the user below the knee during stretching;

providing an actuator coupled to the elongated member;

pivoting, by the actuator, the elongated member about the pivot location to move both the second support and the lower leg portion relative to the upper leg portion and generally toward the upper torso to extend the lower leg portion relative to the upper leg portion and towards the upper torso to cause stretching of at least the hamstring muscle of the leg of the user; and wherein the pivoting of the elongated member about the pivot point urges the thigh support against the upper leg portion above the knee and toward the upper torso.

46. The method of claim 45, further comprising:

providing a first support spaced from the front of the torso of the user, supporting, at least initially, the upper leg portion of the user above the knee with the first support at a position spaced from the front of the torso of the user.

47. The method of claim 46, wherein the thigh support, when the elongated member is pivoting, displaces the upper leg portion of the user away from the first support.

* * * * *